US006848287B1

(12) United States Patent
Huang

(10) Patent No.: US 6,848,287 B1
(45) Date of Patent: Feb. 1, 2005

(54) KEY COLLECTING DEVICE CONTROLLED BY PULLING TRANSVERSELY

(76) Inventor: Joseph Huang, No. 8, Lane 42, Sec. 2, Nan-Kan Road, Lou-Choo Hsieng, To-Yuan Hsien (TW)

( * ) Notice: Subject to any disclaimer, the term of this patent is extended or adjusted under 35 U.S.C. 154(b) by 0 days.

(21) Appl. No.: 10/807,198

(22) Filed: Mar. 24, 2004

(51) Int. Cl.[7] ..... A44B 15/00
(52) U.S. Cl. ..... 70/456 R; 24/3.6; 70/459
(58) Field of Search ..... 70/456 R, 459, 70/460; 24/3.6, 115 G, 598.1, 601.1, 599.5; 206/37.1, 38.1, 37.4, 37.5, 37.6, 37.7, 37.8

(56) References Cited

U.S. PATENT DOCUMENTS

| | | | | | |
|---|---|---|---|---|---|
| 1,219,873 | A | * | 3/1917 | Sapo | 24/102 SL |
| 2,307,808 | A | * | 1/1943 | Segal | 24/600.6 |
| 2,503,211 | A | * | 4/1950 | Ormsbee | 70/459 |
| 2,823,537 | A | * | 2/1958 | Segal | 70/459 |
| 3,478,550 | A | * | 11/1969 | Salvesen | 70/459 |
| 3,776,009 | A | * | 12/1973 | MacGlashan | 70/459 |
| 4,584,858 | A | * | 4/1986 | Wolter | 70/456 R |
| 4,821,543 | A | * | 4/1989 | Scungio | 70/456 R |
| 5,528,916 | A | * | 6/1996 | Song | 70/459 |
| 6,763,692 | B1 | * | 7/2004 | Huang | 70/456 R |

* cited by examiner

*Primary Examiner*—Lloyd A. Gall
(74) *Attorney, Agent, or Firm*—Troxell Law Office PLLC

(57) ABSTRACT

The present invention has a main body and a transverse annular ring being orthogonally connected with the main body for collecting and hanging keys; the main body has therein an elastic engaging latch, and has at its central position a longitudinal central hole, an upper and a lower transverse hole are communicated with the central hole; an upper and a lower section of the annular ring are extended through the upper and the lower transverse holes respectively; and the upper section has at a middle position an access with a diameter slightly larger than that of the central hole for mounting and dismounting. The engaging latch is inserted to connect the central hole, and has near the upper end thereof a control hole to select a state between offsetting from and communicating with the main body; a transverse window is provided beneath the control hole. A positioning sleeve having a solid bottom surface and an upper opening has its bottom surface abutted against the surface of the lower section of the annular ring extending over the lower edge of the window of the engaging latch, so that a spring can be placed into the positioning sleeve from the upper opening of the latter; the upper end of the spring can be abutted against the upper edge of the window, while the lower end of the spring can be abutted against the inner bottom surface of the positioning sleeve.

5 Claims, 5 Drawing Sheets

KEY COLLECTING DEVICE CONTROLLED BY PULLING TRANSVERSELY

BACKGROUND OF THE INVENTION

1. Field of the Invention

The present invention is related to a key collecting device being controlled by pulling transversely, and especially to a key collecting device of which a main-body of a key collecting ring and its related components can be manufactured in a simpler and more convenient way, and loading and detaching of keys in and from it can be faster.

2. Description of the Prior Art

In living at home, working at working sites or being on vehicles for going outside in our modern lives, we use various keys; and we carry key collecting devices on our own persons as necessary articles for the convenience of collecting, tidying and taking keys for use.

Earlier key collecting devices are comprised each of a twin layer annular ring with a notch in order that keys provided with holes can be inserted onto the twin layer annular ring one by one. Such conventional key collecting devices are quite troublesome, hard and inconvenient no matter in inserting in or taking out keys.

As to key collecting devices used in the recent years, taking the U.S. Pat. No. 4,584,858 as an example, it largely improved the convenience of use of the key collecting devices. Principally, such a key collecting device existing presently is provided near the center of a disk surface having a peripheral annular groove with a control knob which links up with an engaging latch provided in the disk. So that the engaging latch normally seals a notch provided in the peripheral annular groove, the notch is opened when the control knob pulls it to retract inwardly. Keys can be connected with a connecting piece with a ball like end in advance, so that the ball like end of the connecting piece can be mounted in or detached from the disk via the notch. In this way, mounting and detaching of the keys in and from a key collecting device can be faster and more convenient; however, this still has some non-ideal defects. For example, processing of the main disk includes processing of the peripheral annular groove, a diametrical groove receiving the engaging latch and a surface slot for positioning the control knob, manufacturing of it is more troublesome, time consumptive and cost higher.

And more, the control knob for controlling mounting and detaching of the keys through the access or the notch normally has a smaller volume and is provided on the disk surface, it is linked up with the abovementioned engaging latch by using a connecting pin extending vertically from the disk surface into the disk; that is, the engaging latch in the disk normally elastically stretched to seal the access or contracted to open the access is indirectly moved by the control knob provided externally and orthogonally, convenience of its operation is not ideal.

SUMMARY OF THE INVENTION

The main object of the present invention is to provide a key collecting device being controlled by pulling transversely, the device largely simplifies manufacturing of the main body and its related components, thereby loading and detaching of keys in and from it can be faster.

To obtain the object, the present invention is provided with a main body and a transverse annular ring being orthogonally connected with the main body for collecting and hanging keys; the main body is provided therein with an elastic engaging latch, and is provided at the central position thereof with a longitudinal central hole extending downwardly from its top for communicating and has a cross-sectional shape in mating with that of the elastic engaging latch, an upper and a low er transverse hole are communicated with the longitudinal central hole; the aforesaid transverse loop is made to have the general shape of a ring by bending a metallic rod with a diameter in corresponding with those of the upper and the lower transverse holes, so that the upper and the lower sections thereof can be extended through the upper and the lower transverse holes respectively; and the upper section is provided at a middle position with an access with a diameter slightly larger than that of the central hole for mounting and dismounting. The elastic engaging latch is inserted to connect the central hole of the main body, and is provided near the upper end thereof with a control hole to select a state between offsetting from and communicating with the main body; a transverse window is provided beneath the control hole. A positioning sleeve having a solid bottom surface and an upper opening has its bottom surface abutted against the surface of the lower section of the transverse loop extending over the lower edge of the window of the elastic engaging latch, so that a spring can be placed into the positioning sleeve from the upper opening of the latter; the upper end of the spring can be abutted against the upper edge of the window, while the lower end of the spring can be abutted against the inner bottom surface of the positioning sleeve.

The present invention will be apparent in the novelty as well as the features thereof after reading the detailed description of the preferred embodiments thereof in reference to the accompanying drawings.

DETAILED DESCRIPTION OF THE PREFERRED EMBODIMENT

Figure 1:
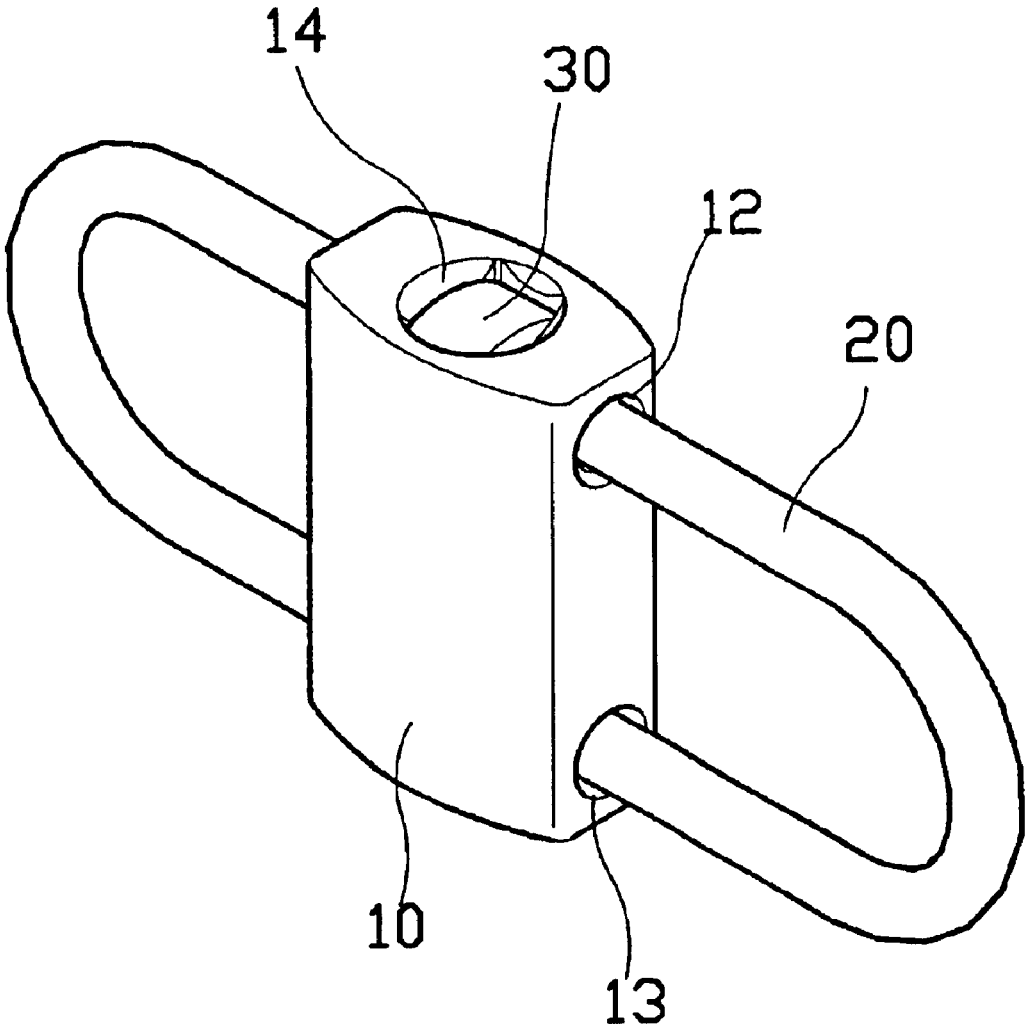
FIG. 1 is a perspective view of a preferred embodiment of the present invention.
Figure 2:
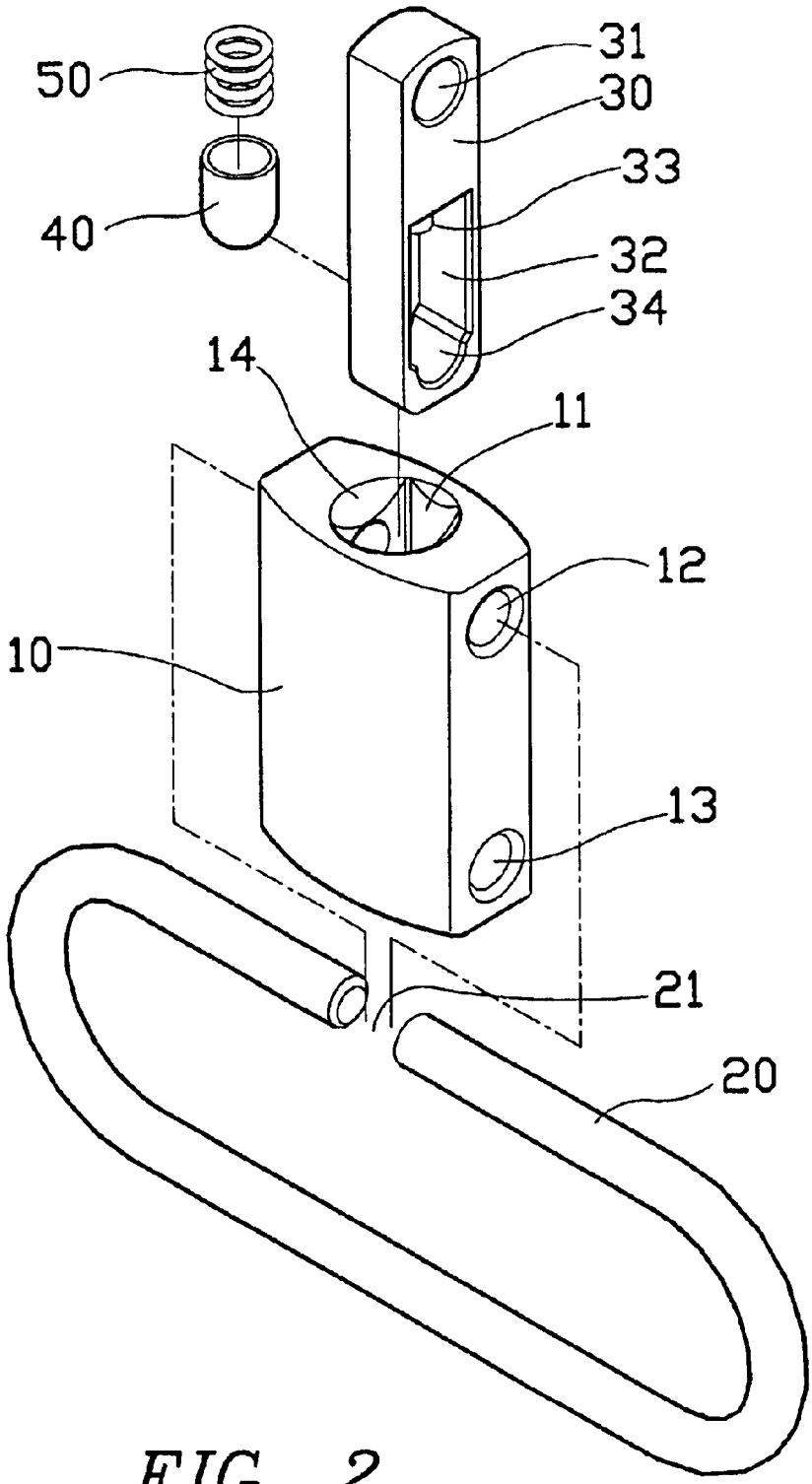
FIG. 2 is an analytic perspective view showing the elements of FIG. 1.
Figure 3:
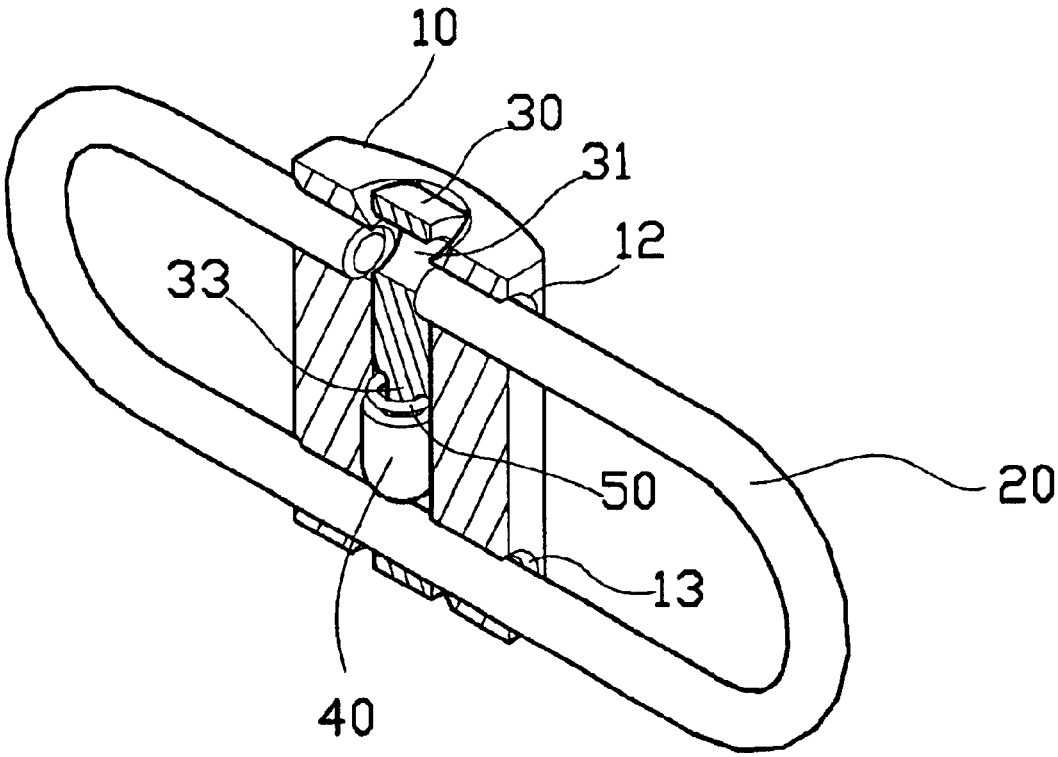
FIG. 3 is a schematic sectional view taken from FIG. 1 showing a locking state.

Referring to FIGS. 1–3, in the preferred embodiment shown, the key collecting device of the present invention has a main body 10, a transverse loop 20 for collecting and hanging keys is orthogonally connected with the main body 10, the main body 10 is provided therein with an elastic engaging latch 30.

The main body 10 is provided at the central position thereof with a longitudinal central hole 11 extending downwardly from its top for communicating, an upper hole 12 and a lower transverse hole 13 respectively at the two lateral sides of the main body 10 are communicated with the longitudinal central hole 11. In this preferred embodiment, the longitudinal central hole 11 is provided on its top end with a flaring truncated conical hole 14 for convenience of pressing the elastic engaging latch 30 with a finger of a user through this flaring truncated conical hole 14. The lower transverse hole 13 can be mated with a lower arciform surface 34 of the transverse loop 20.

The transverse loop 20 being connected transversely with the main body 10 can be shaped by bending a metallic rod with a diameter in corresponding with those of the upper and the lower transverse holes 12, 13, so that an upper and a lower section of the transverse loop 20 in an elongate elliptical shape can be extended through the upper and the lower transverse holes 12, 13 respectively. In this embodiment, the main body 10 of the transverse loop 20 simultaneously forms at the two lateral sides thereof two ring parts for collecting and placing keys simultaneously. And the upper section is provided at a middle position with an access 21 with a diameter slightly larger than that of the central hole 11 for mounting and dismounting.

The abovementioned elastic engaging latch 30 can be inserted to connect the central hole 11 at the middle position of the main body 10, and is provided near the upper end thereof with a control hole 31 to select a state between offsetting from and communicating with the main body 10; a transverse window 32 is provided beneath the control hole 31, and a positioning post 33 is extended down a small distance from the upper edge of the window 32.

A positioning sleeve 40 having a solid bottom surface and an upper opening has its bottom surface abutted against the surface of the lower section of the transverse loop 20 extending over the lower edge 34 of the window 32 of the elastic engaging latch 30, so that a spring 50 can be placed into the positioning sleeve 40 from the upper opening of the latter; the upper end of the spring 50 can be slipped over the positioning post 33 and abutted against the upper edge of the window 32, while the lower end of the spring 50 can be abutted against the inner bottom surface of the positioning sleeve 40.

The lower section of the transverse loop 20 can thereby extended through the lower transverse hole 13 of the main body 10 and can be abutted against the inner bottom surface of the positioning sleeve 40 when in a normal closed state (as shown in FIG. 3), the positioning sleeve 40 thereby can be raised for a set distance, so that the inner spring 50 is elastically pressed. And thereby the access 21 of the upper section of the transverse loop 20 extended through the upper transverse hole 12 of the main body 10 is offset away from the control hole 31 of the elastic engaging latch 30 to form a closed state to allow the two ring parts of the transverse loop 20 at the two lateral sides of the main body 10 to be used for collecting and placing keys (not shown).

Figure 4:
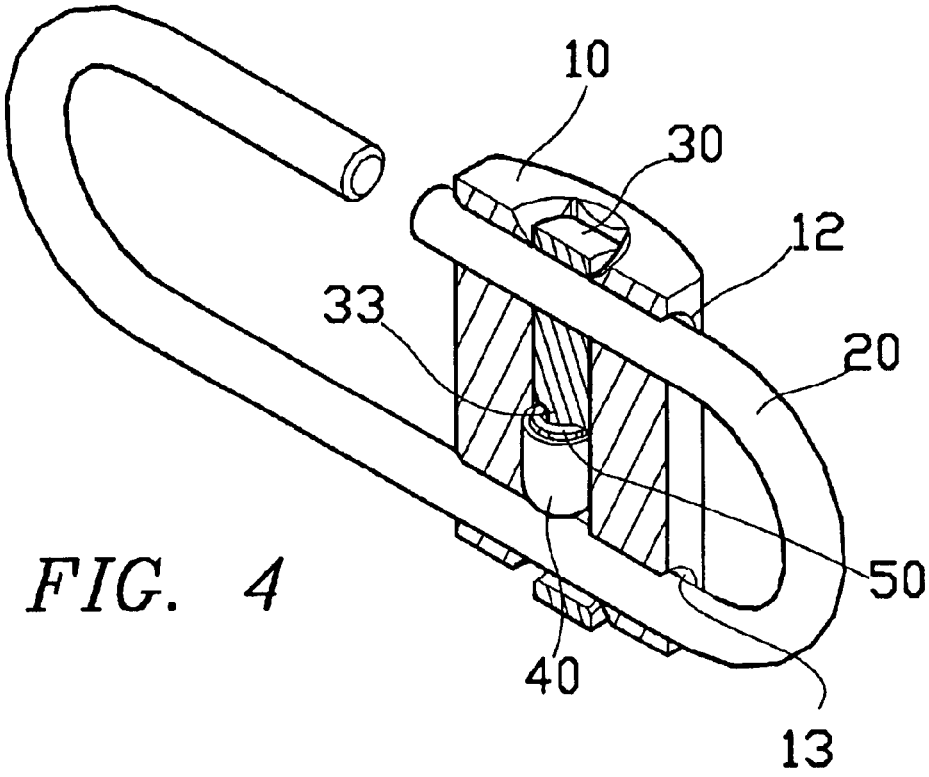
FIG. 4 is a schematic sectional view like FIG. 3 showing an opening state.
Figure 5:
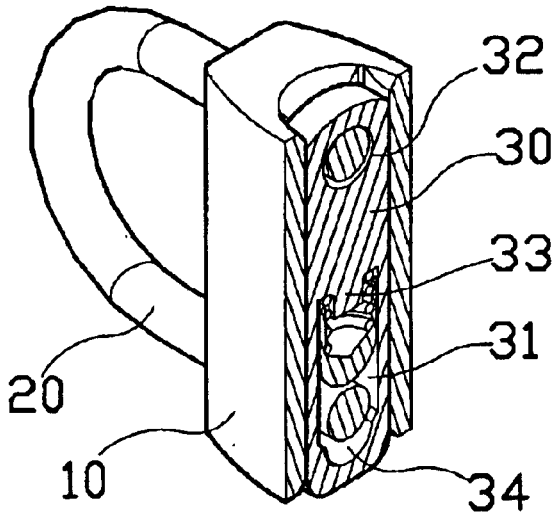
FIG. 5 is a sectional view taken from FIG. 1 in a direction orthogonal to that of FIG. 4.

When the elastic engaging latch 30 in a closed state disclosed above is pressed down with a finger of a user through the flaring truncated conical hole 14 to move the control hole 31 of the elastic engaging latch 30 to a position in communicating with the upper transverse hole 12 of the main body 10 (i.e., they are at an identical horizontal center line), the transverse loop 20 can be pulled transversely out of the main body 10 at the access 21 (as shown in FIG. 4); now it is in an opened state, and the keys can be mounted into the key collecting device or can be taken out of the key collecting device.

The opened state mentioned above is restored to the original closed state by elastically moving back the elastic engaging latch 30 by an elastic restoring force of the inner spring 50 itself when the transverse loop 20 is pulled transversely back to its original position to be at the same vertical center line with the central hole 11 at the access 21.

Figure 6:
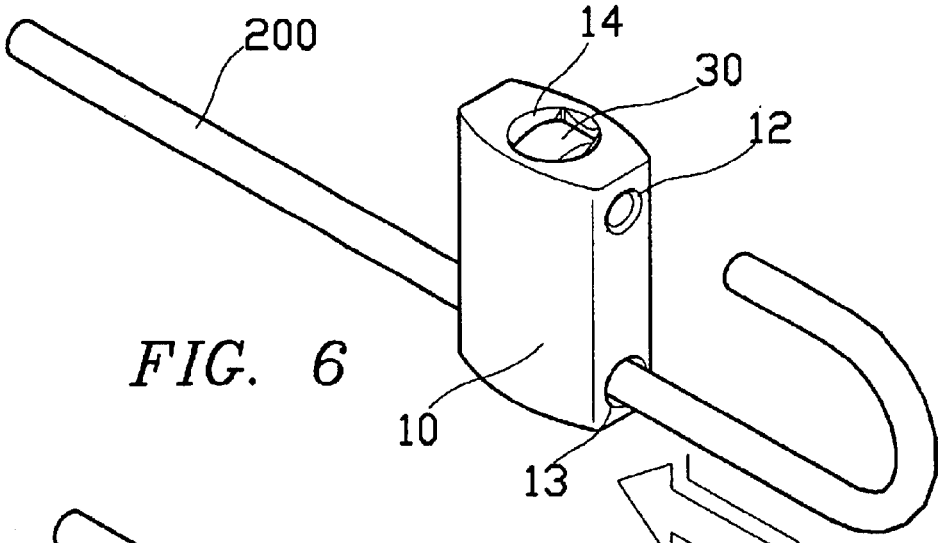
FIGS. 6–8 are schematic perspective views showing process flow charts of the present invention.
Figure 7:
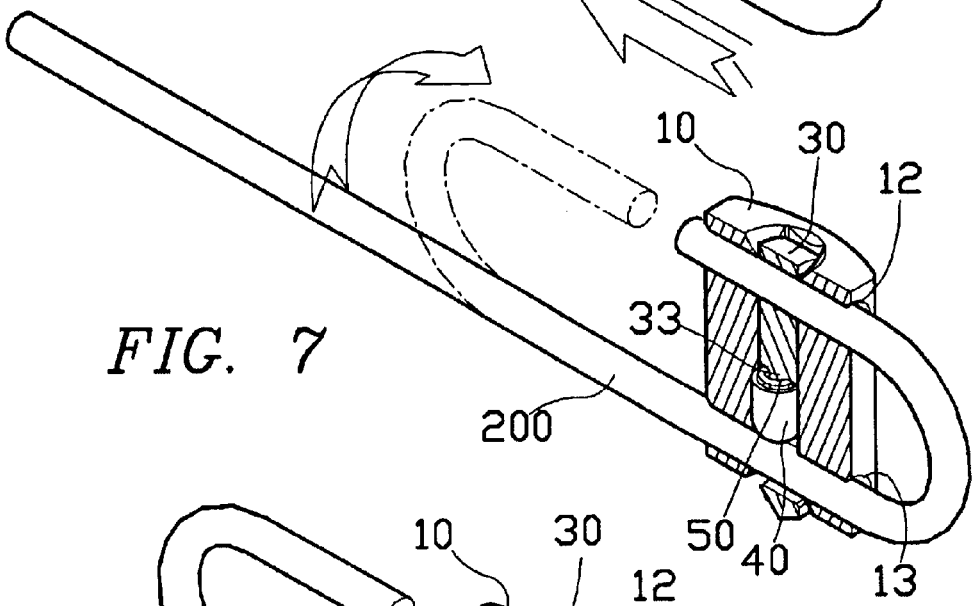
Figure 8:
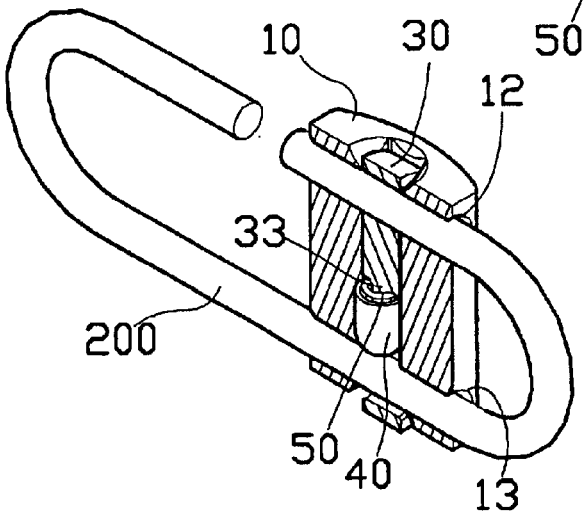

As shown in FIGS. 6–8, the present invention can have a metallic rod 200 with a set length and a set diameter extended in advance the lower transverse hole 13 of the main body 10 and the spring 50 having been placed in the positioning sleeve 40 to make the bottom surface of the positioning sleeve 40 abut against the surface of the lower section (as shown in FIG. 6); then the two ends of the metallic rod 200 are subjected to a bending process (as shown in FIGS. 6, 7), thus the entire metallic rod 200 is formed an elongate elliptical shape as shown in FIG. 8, and the main body has at the two lateral sides thereof two ring parts for mounting and dismounting keys.

The improved structure of the present invention needs only the accessories of a positioning sleeve and a spring by the fact that the main body 10 is structurally simple, the material for the rod to form the loop is easy for processing, so that the entire key collecting device can be faster in manufacturing in a factor, this renders the present invention suitable for mass production to lower the cost of production, and this is the most evident feature of the present invention. And more, the loop for hanging keys can allow opening and closing of the entire key collecting device in a transverse pulling action more easily, operation of it is more smooth and convenient.

The embodiment described is only for illustrating the present invention, and not for giving any limitation to the scope of the present invention. It will be apparent to those skilled in this art that various modifications or changes made to the elements of the present invention without departing from the spirit of this invention shall fall within the scope of the appended claims.

What is claimed is:

1. A key collecting device being controlled by pulling transversely, wherein said device has a main body and a transverse loop being orthogonally connected with said main body for collecting and hanging keys; said main body is provided therein with an elastic engaging latch, and is provided at the central position thereof with a longitudinal central hole with a cross-sectional shape in mating with that of said elastic engaging latch, an upper and a lower transverse hole are communicated with said longitudinal central hole; said transverse loop is made by bending a metallic rod with a diameter in corresponding with those of said upper and the lower transverse holes, so that an upper and a lower section thereof are adapted to extend through said upper and the lower transverse holes respectively; and said upper section is provided at a middle position with an access with a dimension slightly larger than that of said longitudinal central hole; said elastic engaging latch is inserted into said longitudinal central hole of said main body, and is provided near an upper end thereof with a control hole to select a state between offsetting from and communicating with said main body; a transverse window is provided beneath said control hole; a positioning sleeve having a solid bottom surface and an upper opening has its bottom surface abutted against a surface of said lower section of said transverse loop extending over a lower edge of said window of said elastic engaging latch, so that a spring is adapted to be placed into said positioning sleeve from said upper opening of said positioning sleeve; an upper end of said spring is adapted to abut against an upper edge of said window, while a lower end of said spring is adapted to abut against an inner bottom surface of said positioning sleeve.

2. The key collecting device being controlled by pulling transversely as claimed in claim 1, wherein said longitudinal central hole of said main body is provided on its top end with a flaring truncated conical hole for exerting a force for pressing.

3. The key collecting device being controlled by pulling transversely as claimed in claim 1, wherein said lower transverse hole of said main body is mated with a lower arciform surface of said transverse loop.

4. The key collecting device being controlled by pulling transversely as claimed in claim 1, wherein, said metallic rod with a diameter in corresponding with those of said upper and the lower transverse holes is formed by bending an elongate elliptical shape, and said main body has at two lateral sides thereof two ring parts for mounting and dismounting keys.

5. The key collecting device being controlled by pulling transversely as claimed in claim 1, wherein, a positioning post is extended down a small distance from said upper edge of said transverse window of said elastic engaging latch, thus said upper end of said spring is adapted to abut against said upper edge of said window, while said lower end of said spring is adapted to slip over said positioning post and abut against said inner bottom surface of said positioning-sleeve.

* * * * *